US009827595B2

(12) United States Patent
Malmberg

(10) Patent No.: US 9,827,595 B2
(45) Date of Patent: Nov. 28, 2017

(54) SCREENING MEDIA

(71) Applicant: SANDVIK INTELLECTUAL PROPERTY AB, Sandviken (SE)

(72) Inventor: Mats Malmberg, Rydsgard (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/786,850

(22) PCT Filed: Mar. 10, 2014

(86) PCT No.: PCT/EP2014/054558
§ 371 (c)(1),
(2) Date: Oct. 23, 2015

(87) PCT Pub. No.: WO2014/173581
PCT Pub. Date: Oct. 30, 2014

(65) Prior Publication Data

US 2016/0114356 A1 Apr. 28, 2016

(30) Foreign Application Priority Data

Apr. 25, 2013 (EP) ..... 13165267

(51) Int. Cl.
*B07B 1/46* (2006.01)

(52) U.S. Cl.
CPC ..... *B07B 1/4609* (2013.01); *B07B 1/4618* (2013.01)

(58) Field of Classification Search
CPC ..... B07B 1/4609; B07B 1/4618
USPC ..... 209/397
See application file for complete search history.

(56) References Cited

U.S. PATENT DOCUMENTS 4,563,270 A * 1/1986 Wolff ..... B07B 1/469 209/379
2009/0071879 A1* 3/2009 Helmy ..... B07B 1/4618 209/412

FOREIGN PATENT DOCUMENTS

| | | | | |
|---|---|---|---|---|
| CN | 101702887 A | | 5/2010 | |
| DE | 3006364 A | | 1/1986 | |
| DE | 10106499 A1 | | 8/2002 | |
| GB | 725264 | | 3/1955 | |
| GB | 725264 A | * | 3/1955 | ..... B07B 1/4609 |
| WO | 2012029072 A1 | | 3/2012 | |
| WO | WO 2012029072 A1 | * | 3/2012 | ..... B07B 1/4609 |

* cited by examiner

*Primary Examiner* — Terrell Matthews
(74) *Attorney, Agent, or Firm* — Corinne R. Gorski

(57) ABSTRACT

A screening media of a vibrating screen screens fractions of stone or gravel. The screening media is formed of ribs extending from one end of the screening media to the opposite end thereof. Pins projecting perpendicularly from the ribs are placed on opposite sides of the ribs. Each pin ends at a distance from an adjacent rib. The dimension and placement of the pins are such that a continuous aperture is formed between two adjacent ribs. Each aperture is formed of a number of rectangular screening areas of identical size. Each screening area is placed perpendicular to each adjacent screening area and end areas of adjacent screening areas coincide.

12 Claims, 3 Drawing Sheets

SCREENING MEDIA

RELATED APPLICATION DATA

This application is a §371 National Stage Application of PCT International Application No. PCT/EP2014/054558 filed Mar. 10, 2014 claiming priority of EP Application No. 13165267.9, filed Apr. 25, 2013.

TECHNICAL FIELD

The present invention concerns screening media for a vibrating screen.

PRIOR ART

In vibrating screens used for fractionation of for example crushed stones and gravel into fractions of stones with different sizes, screening media are used having screening holes for allowing stones smaller than the screening holes to pass through the holes.

The screening media is normally provided in the form of panels or mats. This description is concentrated to panels to simplify the description, but it is to be understood to apply also for screening mats.

In WO 2012/029072 a screen panel is shown having ribs with protrusions. The apertures forming the screening areas are essentially square in form. The protrusions go almost all the way between the ribs. The distance formed between the protrusions and the adjacent rib is to make the seal panels more resilient, whereby the ribs may yield a bit. This should in theory reduce the risk of clogging.

SUMMARY

For screening media in the mining industry one always seeks high capacity, long life and minimal maintenance requirement. The normally used square or slotted apertures of screening media leads to risk for blinding and not enough open area.

The capacity of a vibrating screen is influenced by a number of factors. One way to increase the capacity is to increase the ratio of open space in the screening media. Regarding the screening media it is also important that it lets the stones through which it is designed to be let through and that it does not clog easily. The screening media should also be durable.

The screening media of the present invention forms a screening area that could be said being formed of a number of rectangular areas placed mutually perpendicular to each other and coinciding at the ends.

Screening media with the apertures of the present invention have more open area, compared to normal screening media of the prior art, which means higher capacity and reduced risk of blinding. By letting the apertures of the screening media have slots directed both along and traverse to the direction of movement for the material to be screened, particles of different shapes are more readily screened.

In some embodiments of the present invention raised bars are used, to facilitate for fine material to be fed down into the screen openings. The raised bars are directed in the direction of movement for the material to be screened.

With the unique aperture design of the present invention there will be an increased open area, compared to what is normal in screening media today. The risk for migrating and blinding is reduced and all material is guided towards the apertures.

Further objects and advantages of the present invention will be obvious to a person skilled in the art, when reading the detailed description below of embodiments of the present invention.

BRIEF DESCRIPTION OF THE DRAWINGS

The invention will be described further below by way of examples and with reference to the enclosed drawings. In the drawings.

DETAILED DESCRIPTION OF EMBODIMENTS

In FIGS. 1, 2, 3 and 4 different embodiments of screening panels according to the present invention are shown. All embodiments of the present invention has one feature in common and that is the shape of the apertures through which the fractions smaller than a predetermined size are to fall. Said shape of the apertures will be discussed further in connection with FIG. 5.

Figure 1A:
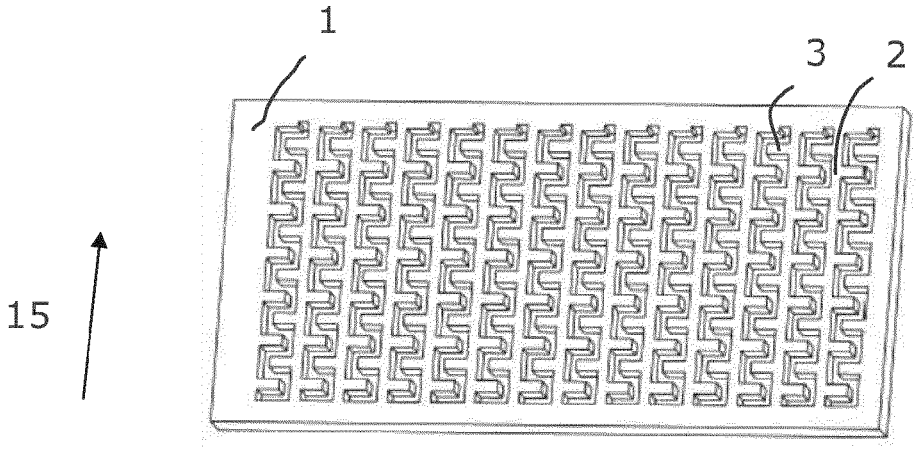
FIGS. 1*a* and 1*b* are a perspective view and a plan view, respectively, of a first embodiment of screening media according to the present invention.
Figure 1B:
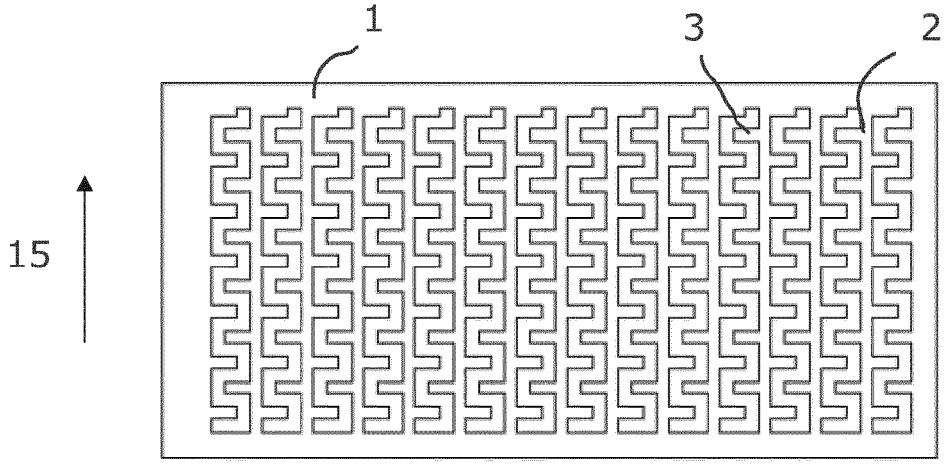

In the first embodiment shown in FIGS. 1*a* and 1*b* the screening media is in the form of a screening panel 1. It is formed of a number of parallel ribs 2, extending from one side to an opposite side of the screening panel 1. From the ribs 2, pins 3 project in opposite directions perpendicular to the ribs 2. The pins 3 are placed with even spacing on respective side of respective rib 2. The upper surfaces of the ribs 2 and the pins 3 projecting from them are flush with each other, thus, the upper surfaces are in a common horizontal plane. The ribs 2 extend in the direction 15 of motion for the matter to be screened.

The pins 3 will have some flexibility in that they have a free outer end. This will reduce the risk of plugging, as the pins 3 may yield to some extent.

In the area between two ribs 2, each pin 3 from one of the ribs 2 is placed in the middle between two pins 3 from the other rib 2. In said area between two ribs 2 pins 3 from alternating ribs 2 are placed with even spacing. The pins 3 do not project all the way to the adjacent rib 2, but stops at a distance from the adjacent rib 2. However, the pins 3 of adjacent ribs 2 project a distance past each other.

Figure 2A:
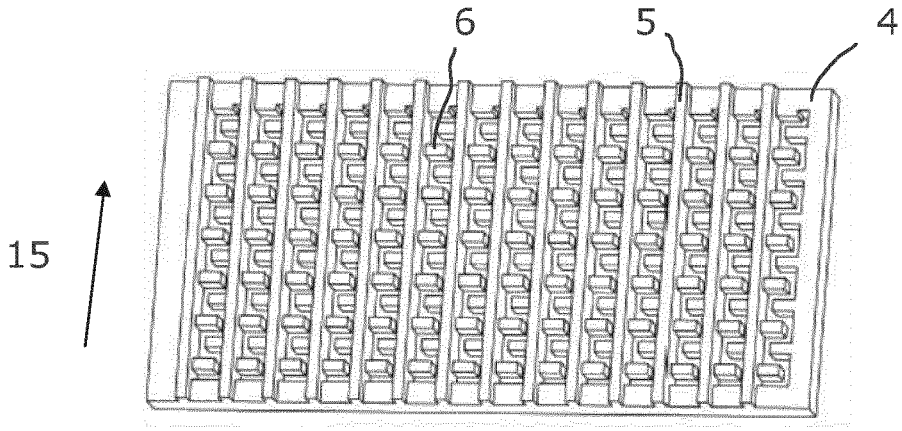
FIGS. 2*a* and 2*b* are a perspective view and a plan view, respectively, of a second embodiment of screening media according to the present invention
Figure 2B:
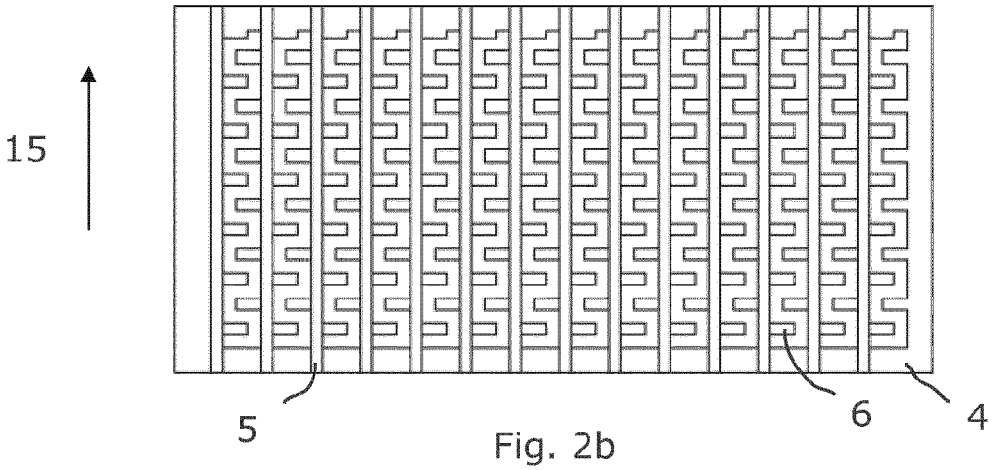

In the second embodiment shown in FIGS. 2*a* and 2*b*, the screening media is in the form of a screening panel 4. The parts of the second embodiment corresponding with the first embodiment will not be described extensively here. The screening panel 4 comprises a number of parallel ribs 5 and pins 6. The ribs 5 extend from one side of the screening panel 4 to an opposite side of the screening panel 4. In this second embodiment the ribs 5 project above the pins 6. The ribs 5 have a rectangular cross section. The mutual positions of the ribs 5 and the pins 6 in relation to each other are the same as for the first embodiment.

Figure 3:
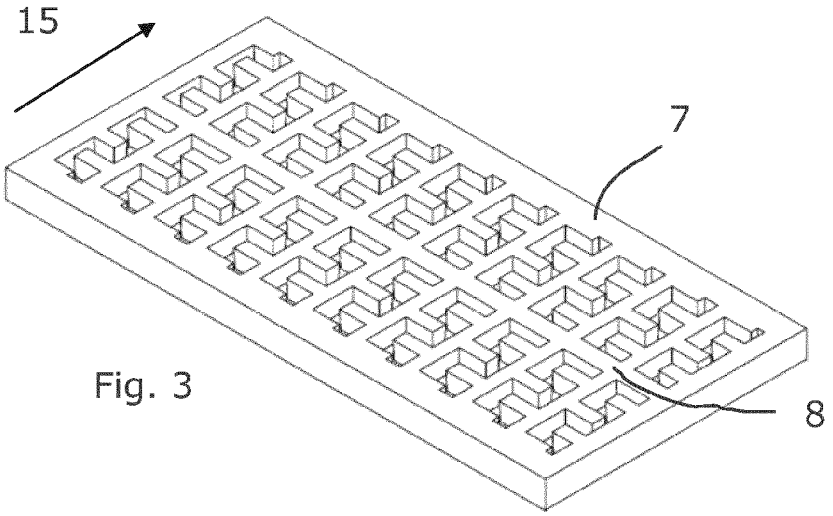
FIG. 3 is a perspective view of a third embodiment of screening media according to the present invention.

The third embodiment of a screening panel 7, shown in FIG. 3, differs from the screening panel 1 of FIG. 1 only in that a bar 8 is placed in the middle of the screening panel 7. The bar 8 is placed perpendicular to the direction 15 of motion for the matter to be screened. The upper surface of the bar 8 is flush with the upper surfaces of the ribs and pins of the screening panel 7. The bar 8 increases the stability of the screening panel 7. The bar 8 will also act against deflection, which may be a problem especially for relatively thin screening media. The mutual position of ribs and pins in relation to each other are the same for this embodiment as for the previous embodiments.

Figure 4:
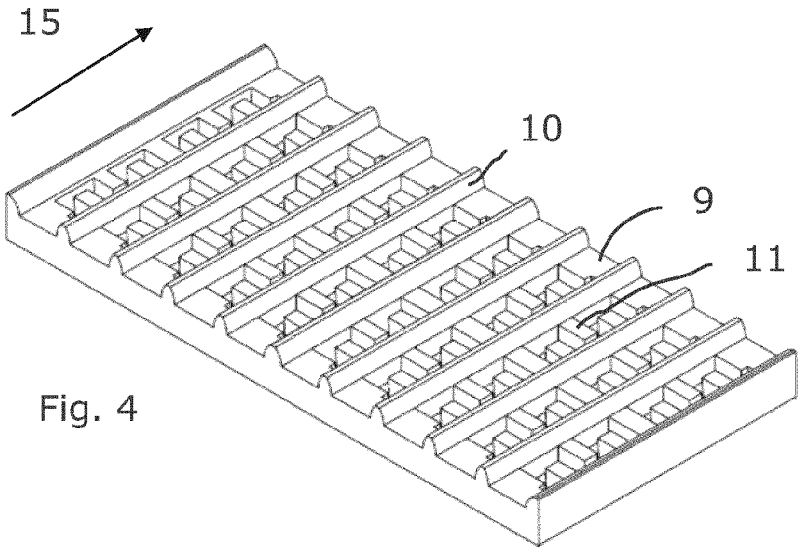
FIG. 4 is a perspective view of a fourth embodiment of screening media according to the present invention.
Figure 5:
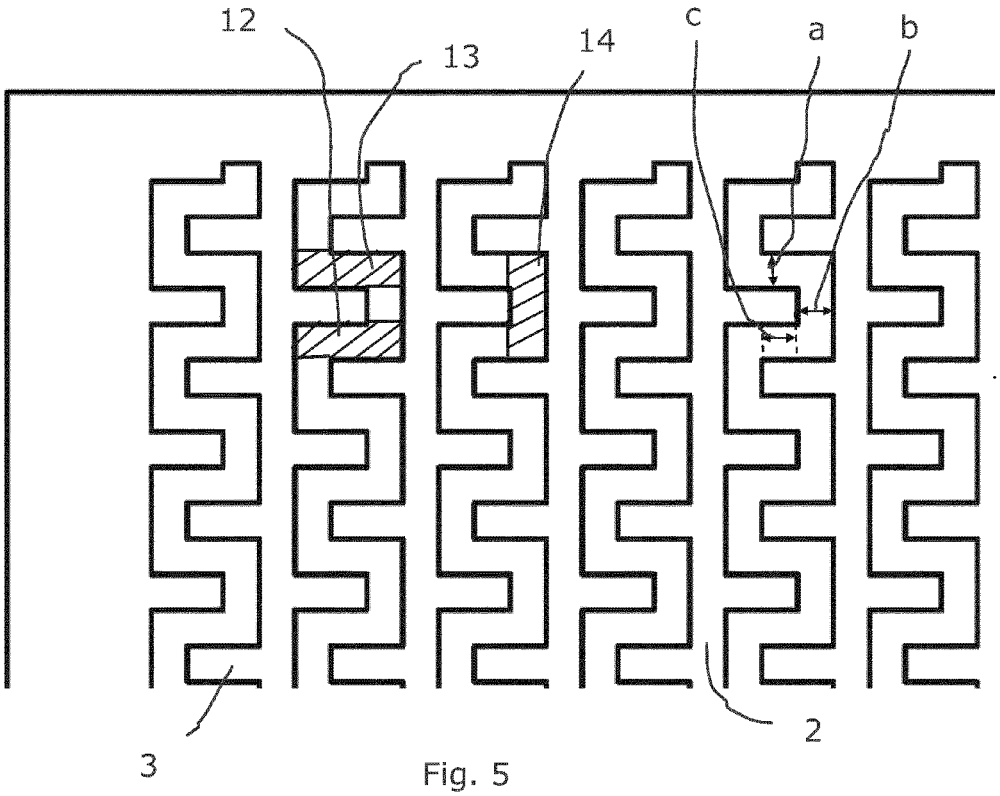
FIG. 5 is a plan view of a part of the screening media of FIG. 1.

In FIG. 4 a fourth embodiment of a screening panel 9 is shown. The screening panel 9 has raised ribs 10, projecting above the rest of the screening panel 9. The raised ribs 10 have a curved upper surface as seen in cross section. The curvature of the upper surface of each raised rib 10 is such that the highest part is in the middle, as seen in cross section. The screening panel 9 of the fourth embodiment has also a bar 11 placed in the middle, corresponding with the bar 8 of the third embodiment of the screening panel 7. The mutual position of ribs and pins in relation to each other are the same for this embodiment as for the previous embodiments.

By means of the design of the ribs 2, 5, 10 and the pins 3, 6, apertures are formed between the ribs 2, 5, 10 and the pins 3, 6 in each screening panel 1, 4, 7, 9. As stated above the apertures have the same shape irrespectively of which screening panel 1, 4, 7, 9 it is referred to. For the discussion of the shape of the apertures we now refer to FIG. 5. There is a continuous aperture between two adjacent ribs 2. In the shown embodiment the apertures could be said to be formed of a number of rectangular screening areas 12, 13, 14 each extending perpendicularly to the adjacent screening area 12, 13, 14. The screening areas coincide at the ends. The dimensions of the ribs 2 and the pins 3 are such that all of the screening areas 12, 13, 14 have the same area. This is achieved in that the distance a between two adjacent pins 3 projecting from different ribs 2 is the same as the distance b between the free end of a pin 3 and the opposite rib 2. Also a distance c between planes containing the free ends of adjacent pins 3 is the same as the above distances a and b. Expressed differently the distance c is the distance two adjacent pins 3 from adjacent ribs 2 each project past the other.

The size of the rectangular screening areas 12, 13, 14 is amended depending on the size of the fraction to be screened. Independently of the size of the rectangular screening areas 12, 13, 14 they are always of the same mutual size. Thus, the above stated distances a, b, c may vary but are always mutually the same. In practice it is the size of the pins 3 that is amended if the size of the fraction to be screened is to be altered. The width of the ribs 2 do not need to be amended even if the size of the pins 3 is altered, but in some cases also the width of the ribs 2 is altered.

Figure 6:
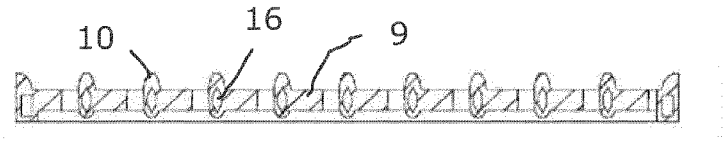
FIG. 6 is across sectional view of the screening media of FIG. 4.

As indicated in FIG. 6 the raised ribs 10 may each have a central reinforcement 16 going through the length of the raised rib 10. The reinforcements 16 are made of any suitably stiff material, including both metal and polymeric materials. Also the raised ribs 5 of the second embodiment may be provided with corresponding reinforcements.

The screening panels 1, 4, 7, 9 of the present invention are preferably produced by injection moulding.

By means of the pattern of the open areas of the screening media of the present invention the open area has both longitudinal and transversal directions, as seen in the direction of movement for the material to be screened. Often screening media have only square or rectangular screening areas. Transversal screening areas counteract blinding or plugging and longitudinal screening areas are beneficial for screening flaking material.

A person skilled in the art realizes that features of the different embodiments may be combined in other ways than in the embodiments shown in the FIGS.

The invention claimed is:

1. A screening media of a vibrating screen for screening fractions of stones or gravel, the screening media comprising:

a plurality of ribs extending from one end of the screening media to an opposite end thereof, each rib having a curved upper surface; and a plurality of pins projecting perpendicularly from the ribs on opposite sides of each rib and ending at a distance from an adjacent rib, the dimension and placement of the pins being arranged to form a continuous aperture between two adjacent ribs, each aperture being formed of a number of rectangular screening areas of identical sizes, each screening area being placed perpendicular to each adjacent screening area such that end areas of adjacent screening areas coincide, wherein the pins on each side of the ribs are placed with even spacing and the distance between adjacent pins projecting from opposite ribs is the same as a distance between a free end of each pin and an opposite rib and a distance with which the free ends of two adjacent pins on adjacent ribs extend past each other.

2. The screening media of claim 1, wherein a pin projecting from one rib is positioned in the middle between two pins projecting from the adjacent rib.

3. The screening media of claim 1, wherein an upper surface of each pin is flush with the upper surface of each rib.

4. The screening media of claim 1, wherein each rib extends above an upper surface of each pin.

5. The screening media of claim 1, wherein each rib extends in the direction of motion for the fraction to be screened.

6. The screening media of claim 1, wherein each rib includes a reinforcement placed inside the rib that extends along the length of the rib.

7. The screening media of claim 6, wherein the reinforcement is made of a polymeric material.

8. The screening media claim 7, wherein a bar is disposed in a middle of the screening media with an extension perpendicular to the direction of motion for the fraction to be screened.

9. The screening media of claim 8, wherein an upper surface of the bar is flush with an upper surface of the pins.

10. The screening media of claim 1, wherein the screening media is made by injection moulding.

11. The screening media of claim 10, wherein the screening media is injection moulded together with reinforcements of the ribs.

12. The screening media of claim 1, wherein the screening media is a screening panel.

* * * * *